US005475891A

United States Patent [19]

Rickey

[11] Patent Number: 5,475,891

[45] Date of Patent: Dec. 19, 1995

[54] SILICONE APPLICATOR FOR PLASTIC EYEGLASS LENSES

[76] Inventor: Ronald P. Rickey, 3550 Qualiview St., Spring Valley, Calif. 91977

[21] Appl. No.: 151,403

[22] Filed: Nov. 12, 1993

[51] Int. Cl.[6] ..... A47L 25/00

[52] U.S. Cl. ..... 15/104.94; 15/184; 15/214

[58] Field of Search ..... 15/184, 104.93, 15/104.94, 144.3, 144.4, 160, 201, 214; 401/269, 268, 272; 106/2, 13, 287.1, 287.12, 287.13, 287.14, 287.16

[56] References Cited

U.S. PATENT DOCUMENTS

| | | | |
|---|---|---|---|
| 770,588 | 9/1904 | Koch | 15/104.94 |
| 1,244,798 | 10/1917 | Tharp et al. | 401/117 |
| 2,681,462 | 6/1954 | Turenes | 15/184 |
| 2,757,094 | 7/1956 | Guss | 106/287.14 |
| 2,868,657 | 1/1959 | Racine | 106/287.14 |
| 3,136,696 | 6/1964 | Harrison | 106/287.13 |
| 3,442,664 | 5/1969 | Heine | 106/287.14 |
| 3,498,922 | 3/1970 | Zisman et al. | 106/287.14 |
| 3,817,769 | 6/1974 | Fisher | 106/287.14 |
| 4,374,745 | 2/1983 | Sibley et al. | 252/106 |
| 4,511,489 | 4/1985 | Requejo et al. | 252/174.15 |
| 4,515,884 | 5/1985 | Field et al. | 106/2 |
| 4,810,407 | 3/1989 | Sandvick | 252/174.15 |
| 5,131,112 | 7/1992 | Cervini | 15/104.94 |
| 5,222,268 | 6/1993 | Snodgrass | 15/160 |
| 5,276,935 | 1/1994 | Lemon et al. | 15/104.94 |
| 5,314,947 | 5/1994 | Sawaragi | 106/287.14 |

FOREIGN PATENT DOCUMENTS

| | | | |
|---|---|---|---|
| 145662 | 12/1935 | Austria | 401/117 |
| 400051 | 10/1933 | United Kingdom | 15/184 |

*Primary Examiner*—David Scherbel
*Assistant Examiner*—Tony G. Soohoo
*Attorney, Agent, or Firm*—John L. Rogitz

[57] ABSTRACT

An applicator for depositing a protective silicone coating onto a plastic eyeglass lens includes a plurality of soft bristles mounted on a gripping element, and the bristles hold the silicone. Preferably, the silicone is a mixture of two polydimethylsiloxane polymers which has about the same index of refraction as the lens. When the bristles are moved against the lens, the polydimethylsiloxane mixture is deposited onto the lens to coat the lens with a protective silicone coating, and to fill in minor imperfections on the surface of the lens. Also, the coating inhibits dust from adhering to the lens, and reduces smudging of the lens. The gripping element is reciprocatingly engaged with a moving member that has an open end. The moving member can be manipulated to move the gripping element between an extended position, wherein the bristles protrude beyond the open end of the moving member, and a retracted position, wherein the bristles do not protrude beyond the open end of the moving member.

8 Claims, 2 Drawing Sheets

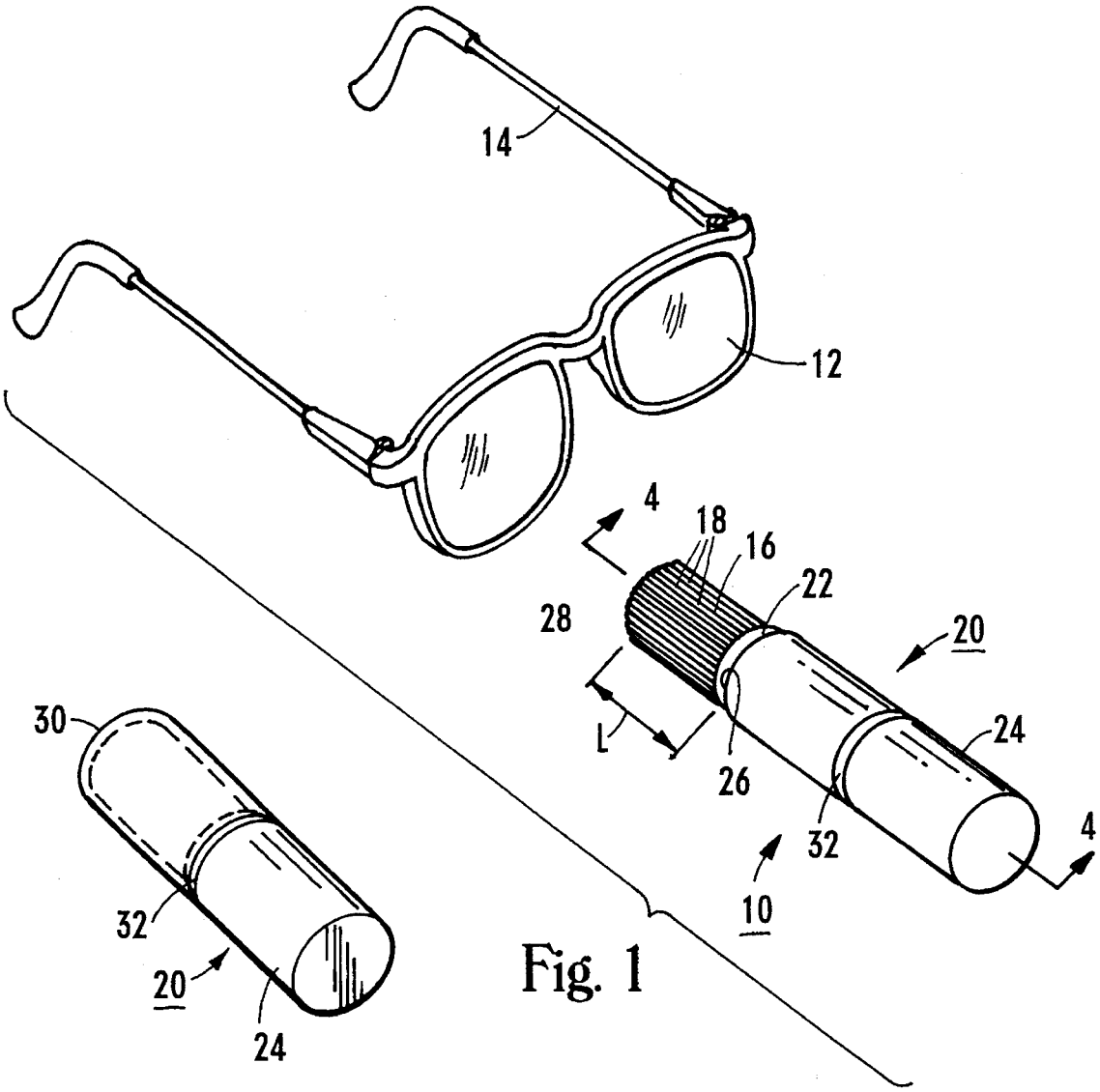
Fig. 1
Fig. 2
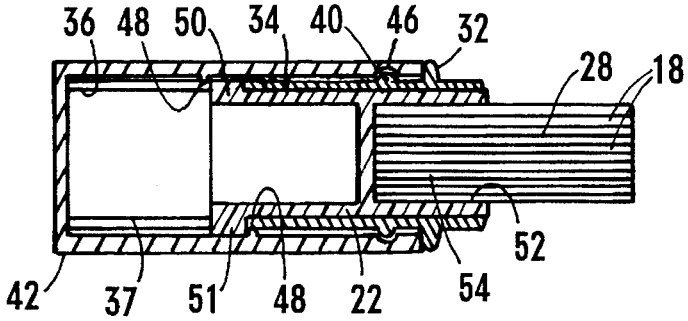
Fig. 4

SILICONE APPLICATOR FOR PLASTIC EYEGLASS LENSES

FIELD OF THE INVENTION

The present invention relates generally to optometry, and more particularly to devices for refurbishing eyeglasses.

Background

Eyeglasses that have plastic lenses are popular for several reasons. They generally weigh less than eyeglasses having glass lenses, making them more comfortable to wear. Also, the plastic lenses are relatively more rugged than glass lenses. Consequently, eyeglasses having plastic lenses are popular among athletes and other active people. Further, for a variety of reasons, eyeglasses that have plastic lenses typically cost less than eyeglasses having glass lenses.

One drawback, however, of plastic lenses is that they are susceptible to being easily scratched, i.e., scored, when a sharp or abrasive object is rubbed against them. Such scratching and scoring frequently occurs as a result of normal wear, and even more frequently occurs when the eyeglasses are worn for active wear and industrial wear.

As can readily be understood, scratches and scores on plastic lenses tend to interfere with light propagation through the lenses, thereby diminishing the usefulness of the plastic lenses. Stated differently, scratches on plastic lenses diminish the clarity of the wearer's vision.

Unfortunately, it is difficult to remove even minor scratches from plastic lenses. Polishing and buffing a plastic lens, for example, to remove scratches can change the light propagation properties of the lens, i.e., change the prescription of the lens. Consequently, once a plastic eyeglass lens is scratched, it ordinarily cannot be repaired, and must instead be replaced.

As recognized by the present invention, it is possible to both fill in scratches from plastic lenses, and to improve the resistance of plastic lenses to scratching. It is accordingly an object of the present invention to provide a device for filling in scratches from plastic lenses. Another object of the present invention is to provide a device for depositing a protective coating on a plastic lens. Still another object of the present invention is to provide an applicator device for eyeglass lenses which is easy to use and cost effective to manufacture.

Summary of the Invention

An applicator for depositing a substance on an eyeglass lens includes the substance and a holder. A plurality of bristles is attached to the holder, and the substance is deposited on the bristles for in turn depositing the substance on the lens when the bristles are moved against the lens. The substance is preferably silicone, and the silicone establishes a smooth protective coating on the lens which reduces scratching of the lens, and which fills in minor scratches and other surface imperfections in the lens. Also, the silicone coating inhibits dust from adhering to the lens, and reduces smudging of the lens. Advantageously, the silicone coating has about the same index of refraction as the lens, so that the light propagation properties of the lens are not significantly affected by the coating.

Preferably, the holder includes a gripping element, and the bristles are fixedly mounted on the gripping element and project longitudinally outwardly therefrom. Also, the holder includes a moving member which has an open end. In accordance with the present invention, the moving member is engaged with the gripping element for moving the gripping element between a retracted position, wherein the bristles do not project beyond the open end of the moving member, and an extended position, wherein the bristles project beyond the open end of the moving member.

In one presently preferred embodiment, the gripping element is formed with an outer cylindrical surface, and at least one ear projects radially outwardly from the outer cylindrical surface. Further, the moving member includes an inner sleeve that has a cylindrical wall, and a channel is formed through the wall. The wall defines a longitudinal axis, and the channel is substantially parallel with the axis of the wall. An outer sleeve which has a cylindrical wall is positioned coaxially around the inner sleeve and is rotatably engaged with the inner sleeve. The cylindrical wall of the outer sleeve has an inner surface facing the inner sleeve and formed with a helical element that protrudes radially inwardly toward the inner sleeve.

Accordingly, the ear of the gripping element projects through the channel of the inner sleeve and abuts the helical element of the outer sleeve. Consequently, the gripping element reciprocates within the moving member between the retracted and extended positions when the outer sleeve is rotated relative to the inner sleeve.

Preferably, the bristles are soft bristles, the lens is made of plastic, and the substance includes silicone. More preferably, the substance is a mixture of a first constituent which includes a polydimethylsiloxane polymer having an average kinematic viscosity of about three hundred fifty centistokes (350 cs). Also, the mixture has a second constituent that includes a polydimethylsiloxane polymer having an average kinematic viscosity of about twenty centistokes (20 cs). In the presently preferred embodiment, he ratio of the first constituent to the second constituent is about 3:1.

In another aspect of the present invention, a device is disclosed for applying silicone to a plastic lens. The device of the present invention includes an applicator element having a silicone substance deposited thereon, and a holder. At least a portion of the applicator element is fixedly attached to the holder such that the holder can be manipulated to urge the applicator element against the lens and thereby deposit the silicone substance onto the lens.

In still another aspect of the present invention, a method is disclosed for depositing a protective silicone coating on a plastic lens. The method of the present invention includes the steps of providing an applicator which has a plurality of soft bristles, and then depositing a silicone substance on the bristles. Then, the bristles are moved against the lens to thereby deposit the silicone substance onto the lens.

The details of the present invention, both as to its construction and operation, can best be understood in reference to the accompanying drawings, in which like numerals refer to like parts, and which:

BRIEF DESCRIPTION OF THE DRAWINGS

FIG. 1 is a perspective view of the applicator device of the present invention, shown in one intended environment with the bristles in the extended position and the protective cap removed;

FIG. 2 is a perspective view of the applicator device with the bristles in the retracted position, with the protective cap engaged with the holder and portions of the holder shown in phantom;

FIG. 4 is a cross-sectional view of the applicator device, as seen along the line 4—4 in FIG. 1.

DETAILED DESCRIPTION OF THE PREFERRED EMBODIMENT

Figure 3:
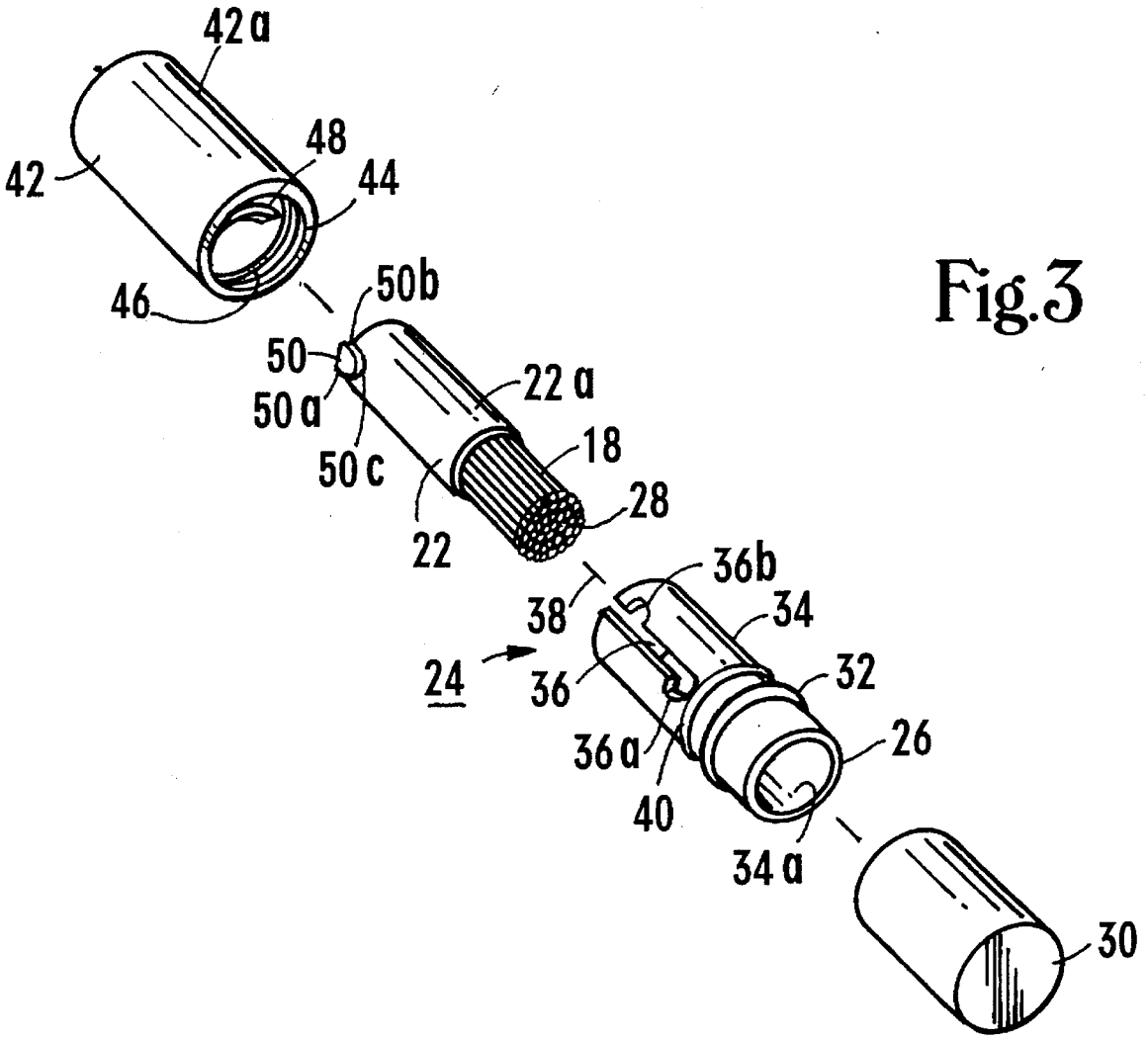
FIG. 3 is an exploded view of the applicator device.

Referring initially to FIG. 1, an applicator, generally designated 10, is shown for depositing a substance on a plastic lens 12 of a pair of spectacles, e.g., eyeglasses, 14. The eyeglasses 14 shown are configured as a person's eyeglasses, but it is to be understood that the principles of the present invention apply to sunglasses, safety goggles, athletic goggles, and so on, provided plastic lenses are used.

As shown, the applicator 10 has an applicator element 16 which can be a plurality of plastic bristles, or a felt wick. In the presently preferred embodiment, however, the applicator element 16 is plurality of soft bristles 18 made, e.g., of goat hair or other animal hair. The length "L" of the portion of the bristles 18 that can contact the lens 12 is between about one and one-half millimeters and three and one-half millimeters (1.5 mm–3.5 mm) and is preferably about two and two-tenths millimeters (2.2 mm).

FIG. 1 shows that the bristles 18 are attached to a holder, generally designated 20. As shown in FIG. 1, the holder 20 includes a gripping element 22 that fixedly holds the bristles 18, and the bristles 18 project longitudinally outwardly from the gripping element 22. Also, the gripping element 22 is movably engaged with a moving member 24 having an open end 26. More specifically, the gripping element 22 with bristles 18 can be reciprocated relative to the moving member 24 between an extended position, shown in FIG. 1, wherein the bristles 18 project beyond the open end 26 of the moving member 24, and a retracted position shown in FIG. 2, wherein the bristles do not project beyond the open end 26 of the moving member 24. Preferably, the gripping element 22 and moving member 24 are made of injection-molded plastic.

A viscous liquid substance 28 is deposited on the bristles 18. Preferably, the substance 28 is a silicone substance, and is deposited on the bristles 18 and between adjacent bristles 18 by injecting or otherwise directing the substance against the applicator element 16. More preferably, the substance 28 is a mixture of a first constituent comprising a polydimethylsiloxane polymer having an average kinematic viscosity of about three hundred fifty centistokes (350 cs) and a second constituent comprising a polydimethylsiloxane polymer having an average kinematic viscosity of about twenty centistokes (20 cs), and the ratio of the first constituent to the second constituent is about 3:1. In the presently preferred embodiment, the first and second constituents of the substance 28 can be procured from Dow Corning, and are sold under the trademark "200® Fluids".

I have found that the above-disclosed silicone-based mixture is sufficiently viscous to be retained on the bristles 18, while permitting relatively easy deposition of the substance 28 onto the plastic lens 12. More specifically, the second constituent facilitates easy and even deposition of the substance 28 onto the lens 12 by brushing the lens 12 with the bristles 18. Then, after deposition, the second constituent evaporates in a matter of hours. After the substance 28 has been deposited onto the lens 12, the lens 12 is wiped with a dry clean cloth or tissue.

The resulting thin silicone-based coating on the lens 12 fills in minor scratches and other surface imperfections of the lens 12. Also, the coating protects the lens 12 from minor scratches and abrasions. Further, the silicone-based coating inhibits dust and other objects from adhering to the lens 12. Additionally, the silicone-based coating reduces smudging of the lens 12 which would otherwise occur, e.g., when a person's fingers are placed against the lens 12.

Moreover, as recognized by the present invention, the above-disclosed substance 28 advantageously has about the same index of refraction as the lens 12. Consequently, the light propagation properties of the lens 12 are not significantly affected by the substance 28.

As can be appreciated in reference to FIG. 1, when the gripping element 22 with bristles 18 is moved to the extended position, the applicator 10 can be manipulated by a person to move the bristles 18 against the lens 12, to thereby deposit the substance 28 onto the lens 12 as a protective coating.

FIG. 2 shows that when the gripping element 22 is in the retracted position, a protective cap 30 can be engaged with the holder 20 by means well-known in the art and abut a toroidal-shaped abutment collar 32 formed on the holder 20. It will be understood that the cap 30 covers the bristles 18 to protect the bristles 18 when not in use.

Now referring to FIG. 3 and 4, the details of the applicator 10 can best be seen. In cross-reference to FIGS. 3 and 4, the moving member 24 has a hollow inner sleeve 34 having a cylindrical wall 34*a*. FIG. 3 best shows that the wall 34*a* of the inner sleeve 34 has a channel 36 formed longitudinally therein. Stated differently, the inner sleeve 34 defines a longitudinal axis 38, and the channel 36 is generally parallel to the axis 38. It can be appreciated in brief reference to FIG. 4 that a second channel channel 37, which is in all essential respects identical in shape to the channel 36, is formed in the wall 34*a* opposite the channel 36 shown in FIG. 3. As shown in FIG. 3, the channel 36 has a first widened portion 36*a* and a second widened portion 36*b*.

FIG. 3 further shows that a toroidal-shaped engagement collar 40 is circumferentially formed on the outside surface of the wall 34*a* of the inner sleeve 34, and the engagement collar 40 protrudes slightly radially outwardly from the wall 34*a*. As can be appreciated in reference to FIG. 3, the engagement collar 40 is smaller in diameter than the abutment collar 32, which is also formed circumferentially on the wall 34*a* of the inner sleeve 34.

Still referring to FIG. 3, a hollow outer sleeve 42 has cylindrical wall 42*a* and an open end 44. A groove 46 is formed circumferentially on the inside surface of the wall 42*a* of the outer sleeve 42. The groove 46 receives the engagement collar 40 of the inner sleeve 34 to hold the inner sleeve 34 in rotatable engagement with the outer sleeve 42, and the sleeves 34, 42 are coaxial. Also, the abutment collar 32 abuts the end 44 of the outer sleeve 42 to limit relative motion between the inner sleeve 34 and outer sleeve 42.

In cross-reference to FIGS. 3 and 4, a helical element 48 is formed on the inner surface of the wall 42*a* of the outer sleeve 42, and the helical element 48 protrudes radially inwardly from the wall 42*a*. It is to be understood from the disclosure above and in reference to the figures that the helical element 48 has a helical shape, extends along a substantial length of the outer sleeve 42, and is formed on the outer sleeve 42 during the molding process.

FIG. 3 best shows that the gripping element 22 has an outer surface 22*a* that is cylindrical in shape, and the gripping element 22 is formed with an ear 50 which protrudes radially outwardly from the outer surface 22*a*. As shown, the ear 50 has straight sides 50*a*, 50*b* and an arcuate front edge 50*c*. In brief reference to FIG. 4, a second ear 51, which is in all essential respects identical to the ear 50, is formed on the surface 22*a* of the gripping element 22 opposite the ear 50.

It can accordingly be appreciated that the ear 50 is slidably engaged with the channel 36 of the inner sleeve 34, and the ear 50 protrudes through the channel 36. Also, the ear 51 is slidably engaged with the channel 37 of the inner sleeve 34, and the ear 51 protrudes through the channel 37. Consequently, the ears 50, 51 abut the helical element 48 of the outer sleeve 42. As the skilled artisan will appreciate, when the inner sleeve 34 is rotated in a first direction relative to the outer sleeve 42, the cooperation between the helical element 48 and the ears 50, 51 urges the gripping element 22 with bristles 18 toward the extended position shown in FIG. 1. When in the extended position, the ear 50 engages the first widened portion 36*a* of the channel 36 to hold the gripping element 22 in the extended position.

On the other hand, when the inner sleeve 34 is rotated in a second direction relative to the outer sleeve 42, the cooperation between the helical element 48 and the ears 50, 51 urges the gripping element 22 with bristles 18 toward the retracted position shown in FIG. 2. When in the retracted position, the ear 50 engages the second widened portion 36*b* of the channel 36 to hold the gripping element 22 in the retracted position.

In other words, he gripping element 22 reciprocates within the moving member 24 between the retracted and extended positions when the outer sleeve 42 is rotated relative to the inner sleeve 34.

As best shown in FIG. 4, the bristles 18 are firmly attached to the gripping element 22 by suitable means well-known in the art. Preferably, the bristles 18 are anchored in a cavity 52 of the gripping element 22 by injecting a bonding substance 54, such as epoxy, into the cavity 52 and between adjacent bristles 18.

While the particular silicone applicator for plastic eyeglass lenses as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

What is claimed is:

1. An applicator for depositing a substance on an eyeglass lens, comprising:

a plurality of bristles holding the substance for depositing the substance on the lens when the bristles are moved against the lens, the substance including a first constituent comprising a polydimethylsiloxane polymer having an average kinematic viscosity of about three hundred fifty centistokes (350 cs) and a second constituent comprising a polydimethylsiloxane polymer having an average kinematic viscosity of about twenty centistokes (20 cs);

a moving member having an open end; and a gripping element reciprocally disposed within the moving member, wherein the bristles are fixedly mounted on the gripping element and project longitudinally outwardly therefrom and wherein the moving member moves the gripping element between a retracted position, wherein the bristles do not project beyond the open end of the moving member, and an extended position, wherein the bristles project beyond the open end of the moving member.

2. The applicator of claim 1, wherein the gripping element is formed with an outer cylindrical surface and at least one ear projecting radially outwardly from the outer cylindrical surface and slidably engaged with the moving member.

3. The applicator of claim 2, wherein the moving member includes:

an inner sleeve having a first cylindrical wall formed with a channel therethrough, the sleeve defining a longitudinal axis, the channel being substantially parallel with the axis of the sleeve; and an outer sleeve having a second cylindrical wall positioned coaxially with the inner sleeve and rotatably engaged therewith, the second cylindrical wall having an inner surface facing the inner sleeve and formed with a helical element protruding radially inwardly toward the inner sleeve, wherein the ear of the gripping element projects through the channel of the inner sleeve and abuts the helical element of the outer sleeve, such that the gripping element reciprocates within the moving member between the retracted and extended positions when the outer sleeve is rotated relative to the inner sleeve.

4. The applicator of claim 1, wherein the bristles are soft bristles.

5. The applicator of claim 1, wherein the ratio of the first constituent to the second constituent is about 3:1.

6. A device for applying silicone to a plastic lens, comprising:

a plurality of bristles having an active substance consisting of silicone deposited thereon;

a moving member having an open end; and a gripping element reciprocally disposed within the moving member, wherein the bristles are fixedly mounted on the gripping element and project longitudinally outwardly therefrom and wherein the moving member moves the gripping element between a retracted position, wherein the bristles do not project beyond the open end of the moving member, and an extended position, wherein the bristles project beyond the open end of the moving member.

7. The device of claim 6, wherein the gripping element is formed with an outer cylindrical surface and at least one ear projecting radially outwardly from the outer cylindrical surface, and the moving member includes:

an inner sleeve having a first cylindrical wall formed with a channel therethrough, the sleeve defining a longitudinal axis, the channel being substantially parallel with the axis of the sleeve; and an outer sleeve having a second cylindrical wall positioned coaxially with the inner sleeve and rotatably engaged therewith, the second cylindrical wall having an inner surface facing the inner sleeve and formed with a helical element protruding radially inwardly toward the inner sleeve, wherein the ear of the gripping element projects through the channel of the inner sleeve and abuts the helical element of the outer sleeve, such that the gripping element reciprocates within the moving member between the retracted and extended positions when the outer sleeve is rotated relative to the inner sleeve.

8. The device of claim 7, wherein the silicone substance is a mixture of a first constituent comprising a polydimethylsiloxane polymer having an average kinematic viscosity of about three hundred fifty centistokes (350 cs) and a second constituent comprising a polydimethylsiloxane polymer having an average kinematic viscosity of about twenty centistokes (20 cs), and the ratio of the first constituent to the second constituent is about 3:1.

* * * * *